US009925455B2

(12) United States Patent
Fisher et al.

(10) Patent No.: US 9,925,455 B2
(45) **Date of Patent: *Mar. 27, 2018**

(54) SYLLABIC ROULETTE GAME WITH SOLMIZATION, AND METHOD

(71) Applicant: CG TECHNOLOGY, L.P., Las Vegas, NV (US)

(72) Inventors: Donald Fisher, Cary, IL (US); Melissa S. Langtim, Elgin, IL (US); Douglas Krich, Cary, IL (US); Darlene Marie Garmann, Watford City, ND (US); Stephen Foote, Queensland (AU)

(73) Assignee: CG TECHNOLOGY, L.P., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/727,367

(22) Filed: Jun. 1, 2015

(65) Prior Publication Data

US 2015/0265913 A1 Sep. 24, 2015

Related U.S. Application Data

(63) Continuation-in-part of application No. 12/746,408, filed as application No. PCT/AU2007/001880 on (Continued)

(51) Int. Cl.
*A63F 9/24* (2006.01)
*A63F 5/02* (2006.01)
(Continued)

(52) U.S. Cl.
CPC ..... *A63F 5/02* (2013.01); *A63F 5/0088* (2013.01); *A63F 9/0098* (2013.01); *A63F 2003/00132* (2013.01); *A63F 2009/247* (2013.01)

(58) Field of Classification Search
CPC ..... A63F 5/02
See application file for complete search history.

(56) References Cited

U.S. PATENT DOCUMENTS 958,722 A 5/1910 Chalmers
1,520,697 A 12/1924 Carlson
(Continued)

FOREIGN PATENT DOCUMENTS

CA 2709614 6/2016
CH 620782 12/1980
(Continued)

OTHER PUBLICATIONS

U.S. Office Action for U.S. Appl. No. 11/732,995; dated Jul. 9, 2010; 11 pages.
(Continued)

*Primary Examiner* — Michael Dennis

(57) ABSTRACT

A roulette game enables single-spin formation of meaningful character strings, which character strings may be coupled to tones for enhancing the gaming experience. The meaningful character strings may be defined by solfege-enabling letter groups, which letter groups may prompt underlying tones in solmization. The syllabic roulette game comprises a roulette wheel, a wager-enabling layout, and a plurality of balls. The wheel comprises alphabetic characters against a rainbow colored backdrop for enabling various payout schemes. A color-coordinated wager support surface is preferably disposed adjacent the roulette wheel for facilitating wager placement.

9 Claims, 12 Drawing Sheets

Related U.S. Application Data

Dec. 5, 2007, now Pat. No. 9,044,667, and a continuation-in-part of application No. 11/711,374, filed on Feb. 27, 2007, now Pat. No. 8,267,403, which is a continuation of application No. 11/634,780, filed on Dec. 5, 2006, now abandoned, said application No. 12/746,408 is a continuation-in-part of application No. 11/711,546, filed on Feb. 27, 2007, now Pat. No. 7,926,810, which is a continuation-in-part of application No. 11/634,780, filed on Dec. 5, 2006, now abandoned, said application No. 12/746,408 is a continuation-in-part of application No. 11/732,995, filed on Apr. 5, 2007, now abandoned, which is a continuation-in-part of application No. 11/634,780, filed on Dec. 5, 2006, now abandoned, and a continuation-in-part of application No. 11/711,374, filed on Feb. 27, 2007, now Pat. No. 8,267,403, and a continuation-in-part of application No. 11/711,546, filed on Feb. 27, 2007, now Pat. No. 7,926,810.

(51) Int. Cl.

| | |
|---|---|
| ***A63F 5/00*** | (2006.01) |
| ***A63F 9/00*** | (2006.01) |
| *A63F 3/00* | (2006.01) |

(56) References Cited

U.S. PATENT DOCUMENTS

| | | | | |
|---|---|---|---|---|
| 1,676,410 | A | 7/1928 | Paul | |
| 1,709,401 | A | 4/1929 | Hermann | |
| 2,087,555 | A | 7/1937 | Simpson | |
| 2,210,201 | A | 8/1940 | Draper et al. | |
| D159,405 | S | 7/1950 | Bossart | |
| 2,721,082 | A | 10/1955 | Hunold | |
| 3,090,623 | A | 5/1963 | Dugan | |
| 3,583,701 | A | 6/1971 | Glass et al. | |
| 3,853,324 | A | 12/1974 | Reiner et al. | |
| 3,989,252 | A | 11/1976 | Mattson | |
| 4,095,794 | A | 6/1978 | Garto et al. | |
| 4,149,728 | A | 4/1979 | Thompson | |
| 4,222,561 | A | 9/1980 | Whitten | |
| 4,357,015 | A | 11/1982 | Santora et al. | |
| 4,690,409 | A | 9/1987 | Scalia | |
| 4,778,186 | A | 10/1988 | Dudley | |
| 4,941,665 | A | 7/1990 | Klamer | |
| 5,042,810 | A | 8/1991 | Williams | |
| 5,102,135 | A | 4/1992 | Addiechi | |
| 5,259,616 | A | 11/1993 | Bergmann | |
| 5,280,909 | A | 6/1994 | Tracy | |
| 5,560,603 | A | 10/1996 | Seelig et al. | |
| 5,755,440 | A * | 5/1998 | Sher | A63F 5/00 273/142 E |
| 5,857,909 | A | 1/1999 | Rubin | |
| 5,934,999 | A | 8/1999 | Valdez | |
| 6,083,105 | A | 7/2000 | Ronin et al. | |
| 6,164,647 | A | 12/2000 | Chee | |
| 6,227,542 | B1 | 5/2001 | Cosmi | |
| 6,406,022 | B1 | 6/2002 | Nadibaidze | |
| 6,575,831 | B1 | 6/2003 | Gonen | |
| 6,575,834 | B1 | 6/2003 | Lindo | |
| 6,663,106 | B1 | 12/2003 | Cosmi | |
| 6,869,359 | B1 | 3/2005 | Mathews | |
| 6,921,072 | B2 | 7/2005 | Hughes-Watts | |
| 6,991,509 | B1 * | 1/2006 | Carley | A63H 5/00 434/334 |
| 7,094,150 | B2 | 8/2006 | Ungaro et al. | |
| 2003/0060263 | A1 | 3/2003 | Pearce | |
| 2003/0094752 | A1 | 5/2003 | Mathews | |
| 2004/0061285 | A1 | 4/2004 | Hughes-Watts | |
| 2004/0077398 | A1 | 4/2004 | Jarvis | |
| 2005/0167912 | A1 | 8/2005 | Sokolov | |
| 2005/0261048 | A1 | 11/2005 | Evans | |
| 2005/0285336 | A1 * | 12/2005 | Ilievski | A63F 5/00 273/143 R |
| 2006/0055109 | A1 | 3/2006 | Yokota et al. | |
| 2006/0178191 | A1 | 8/2006 | Ellis | |
| 2006/0249907 | A1 | 11/2006 | Wong et al. | |
| 2007/0021192 | A1 | 1/2007 | Tamimoto | |
| 2007/0246883 | A1 | 10/2007 | Cudlipp | |
| 2008/0085756 | A1 | 4/2008 | Okada | |
| 2008/0128986 | A1 | 6/2008 | Fisher | |
| 2008/0128991 | A1 | 6/2008 | Fisher | |
| 2008/0132316 | A1 | 6/2008 | Fisher | |
| 2009/0069085 | A1 | 3/2009 | Borissov | |
| 2011/0275432 | A1 | 11/2011 | Lutnick | |
| 2012/0094734 | A1 | 4/2012 | Fisher | |

FOREIGN PATENT DOCUMENTS

| | | |
|---|---|---|
| DE | 2503326 | 7/1976 |
| GB | 1113668 | 5/1968 |
| GB | 2304295 | 3/1997 |
| GB | 2413773 | 11/2005 |
| JP | H07-155470 | 6/1995 |
| JP | 2005-305030 | 11/2005 |
| JP | 2006-333907 | 12/2006 |
| WO | WO 95/05877 | 3/1995 |
| WO | WO 2008/067596 | 6/2008 |
| WO | WO 2008/067604 | 6/2008 |
| ZA | 8905737 | 4/1990 |

OTHER PUBLICATIONS

International Search Report for PCT/AU2007/001880 dated Mar. 7, 2008; 5 pages.

U.S. Office Acton for U.S. Appl. No. 11/711,546 dated Sep. 29, 2009; 9 pages.

U.S. Office Action for U.S. Appl. No. 11/732,995; dated Oct. 2, 2009; 16 pages.

U.S. Office Action for U.S. Appl. No. 11/711,374; dated Dec. 6, 2010; 18 pages.

Notice of Allowance for U.S. Appl. No. 11/711,546 dated Dec. 9, 2010; 7 pages.

AU Examiner Report for Application No. 2007329184 dated Mar. 25, 2011; 2 pages.

U.S. Office Action for U.S. Appl. No. 11/711,374; dated Oct. 21, 2011; 7 pages.

U.S. Office Action for U.S. Appl. No. 11/732,995; 11 pages; dated Mar. 12, 2012.

U.S. Office Action for U.S. Appl. No. 11/732,995; 11 pages; dated Sep. 1, 2011.

Notice of Allowance for U.S. Appl. No. 11/711,546 dated Jul. 12, 2010; 6 pages.

AU Examiner Report for App No. 2007329176 dated Feb. 2, 2012; 4 pages.

Notice of Allowance for U.S. Appl. No. 11/711,374; dated May 11, 2012; 9 pages.

U.S. Office Action for U.S. Appl. No. 11/711,374; dated Jun. 18, 2009; 7 pages.

U.S. Office Action for U.S. Appl. No. 12/746,408; dated Jan. 16, 2013; 6 pages.

U.S. Office Action for U.S. Appl. No. 12/746,408; dated May 29, 2013; 13 pages.

U.S. Final Office Action for U.S. Appl. No. 12/746,408; dated Feb. 13, 2014; 13 pages.

MY Substantive Examination Adverse Report for App. No. PI 20092295; dated Sep. 14, 2012, 4 pages.

CA Examiner's Requisition for App. No. 2,709,614; dated Mar. 13, 2012; 2 pages.

CA Examiner's Requisition for App. No. 2,709,614; dated Jun. 25, 2013; 3 pages.

CA Examiner's Requisition for App. No. 2,709,614; dated Jun. 2, 2014; 4 pages.

JP Office Action for App. No. 2010-536283; dated May 28, 2013; 4 pages (w/English translation).

(56) References Cited

OTHER PUBLICATIONS

AU Examination Report No. 1 for App. No. 2012268810; dated Oct. 29, 2014; 3 pages.
AU Examination Report for App. No. 2013251264; dated Jul. 22, 2015; 4 pages.
JP Office Action for App. No. 2014-020257; dated May 10, 2016; 4 pages (w/English translations).
JP Office Action for App. No. 2014-020257; dated Jun. 30, 2015; 4 pages (w/English translations).
MY Substantive Examination Adverse Report for App. No. PI 20092295; dated Nov. 13, 2015, 4 pages.
MY Substantive Examination Adverse Report for App. No. PI 2013000478; dated Jun. 30, 2015; 5 pages.
MY Substantive Examination Adverse Report for App. No. PI 2013000478; dated Apr. 15, 2016; 4 pages.
CA Examiner's Requisition for App. No. 2926495; Jul. 31, 2017; 4 pages.
JP Office Action for App. No. 2016-218861; Jun. 20, 2017; 10 pages (w/English translations).

* cited by examiner

9

Payout Table

| Bet Name | Numbers | Payout | Expectation |
|---|---|---|---|
| Straight | 1 | 7 | 0.9231 |
| Split | 2 | 2/30 | 0.9231 |
| Street | 3 | Even/11/50 | 0.9231 |
| Corner | 4 | 0/4/44 | 0.9231 |
| Double Street | 6 | 0/99 | 0.9231 |
| Column | 8 | Even 3/5 | 0.9231 |
| Green | 2 | 0/2/15 | 0.9231 |
| RAINBO | 4 | 0/1 to 2/2 to 7 | 0.9231 |

20

Mystery Parameters

| Minimum | Maximum | Percentage |
|---|---|---|
| 1,000 | 3,000 | 0.05 |
| 100 | 500 | 0.666 |
| 10 | 20 | 1.5 |

FIG. 10

21

Payout Table

| Bet Name | Numbers | Payout | Expectation |
|---|---|---|---|
| Straight | 1 | 11 | 0.9231 |
| Split | 2 | 4/59 | 0.9231 |
| Street | 3 | 2/30 | 0.9231 |
| Double Street | 6 | 1/3 | 0.9231 |
| Green | 2 | 4/59 | 0.9231 |
| R A I N B O | 4 | Even/19 | 0.9108 |
| First/Last 12 | 12 | 0/7 to 2 | 0.9138 |
| Column | 8 | 0/10 | 0.9477 |
| Scales | 7 pairs | Jackpot | Variable |

FIG. 11

| Payout Table | | | |
|---|---|---|---|
| Bet Name | Numbers | Payout | Expectation |
| Straight | 1 | 7 | 0.9231 |
| Split | 2 | 2/30 | 0.9231 |
| Street | 3 | Even/11/50 | 0.9219 |
| Half Dozen | 6 | 0/4/44 | 0.9231 |
| Green | 2 | 0/99 | 0.9231 |
| RAINBO | 4 | Even/3/5 | 0.9108 |
| Column | 8 | 0/2/15 | 0.9262 |
| First/LAST 12 | 12 | 0/1 to 2/2 to 7 | 0.9138 |
| Win Prog. | 3 | 0/0/PROGRESSIVE | Variable |

| Payout Table | | | |
|---|---|---|---|
| Bet Name | Numbers | Payout | Expectation |
| Straight | 1 | 11 | 0.9231 |
| Split | 2 | 4/59 | 0.9231 |
| Street | 3 | 2/30 | 0.9231 |
| Double Street | 6 | 1/3 | 0.9231 |
| Green | 2 | 4/59 | 0.9231 |
| R A I N B O | 4 | Even/19 | 0.9108 |
| First/Last 12 | 12 | 0/7 to 2 | 0.9138 |
| Column | 8 | 0/10 | 0.9477 |
| Scales | 7 pairs | Jackpot | Variable |

| Payout Table | | | |
|---|---|---|---|
| Bet Name | Numbers | Payout | Expectation |
| Straight | 1 | 29 | 0.9091 |
| Split | 2 | 14 | 0.9091 |
| Split | 3 | 9 | 0.9091 |
| Double Street | 6 | 4 | 0.9091 |
| Column | 10 | 2 | 0.9091 |
| FIRST LAST 15 | 15 | Even | 0.9091 |
| Green | 3 | 9 | 0.9091 |
| RAINBO | 5 | 6 | 0.9091 |

Payout Table

| Bet Name | Numbers | Payout | Expectation |
|---|---|---|---|
| Straight | 1 | 29 | 0.9091 |
| Split | 2 | 14 | 0.9091 |
| Split | 3 | 9 | 0.9091 |
| Double Street | 6 | 4 | 0.9091 |
| Column | 10 | 2 | 0.9091 |
| FIRST LAST 15 | 15 | Even | 0.9091 |
| Green | 3 | 9 | 0.9091 |
| RAINBO | 5 | 6 | 0.9091 |

FIG. 18

Mystery Parameters

| Minimum | Maximum | Percentage |
|---|---|---|
| 1,000 | 3,000 | 0.05 |
| 100 | 500 | 0.666 |

FIG. 19

SYLLABIC ROULETTE GAME WITH SOLMIZATION, AND METHOD

CROSS-REFERENCE TO RELATED APPLICATIONS

This application is continuation-in-part of, and claims priority from, U.S. patent application Ser. No. 12/746,408, which has a 35 USC 371(c) date of Nov. 15, 2011 (U.S. Patent Application Publication No. 2012/0094734).

U.S. patent application Ser. No. 12/746,408 is a national stage application of, and claims priority from, International application No. PCT/AU2007/001880, filed on Dec. 5, 2007 (International Publication No. WO 2008/067604).

U.S. patent application Ser. No. 12/746,408, is also a continuation-in-part of, and claims priority from, U.S. patent application Ser. No. 11/711,374, filed on Feb. 27, 2007 (U.S. Pat. No. 8,267,403), which is a continuation of, and claims priority from, U.S. patent application Ser. No. 11/634,780, filed on Dec. 5, 2006 (U.S. Patent Application Publication No. 2008/0128986).

U.S. patent application Ser. No. 12/746,408, is also a continuation-in-part of, and claims priority from, U.S. patent application Ser. No. 11/711,546, filed on Feb. 27, 2007 (U.S. Pat. No. 7,926,810), which is a continuation-in-part of, and claims priority from, U.S. patent application Ser. No. 11/634,780, filed on Dec. 5, 2006.

U.S. patent application Ser. No. 12/746,408, is also a continuation-in-part of, and claims priority from, U.S. patent application Ser. No. 11/732,995, filed on Apr. 5, 2007 (U.S. Patent Application Publication No. 2008/0132316), which is a continuation-in-part of, and claims priority from, (1) U.S. patent application Ser. No. 11/634,780, filed on Dec. 5, 2006, (2) U.S. patent application Ser. No. 11/711,374, filed on Feb. 27, 2007, and (3) U.S. patent application Ser. No. 11/711,546, filed on Feb. 27, 2007.

The contents of U.S. patent application Ser. No. 12/746,408, the contents of International Application No. PCT/AU2007/001880, the contents of U.S. patent application Ser. No. 11/634,780, the contents of U.S. patent application Ser. No. 11/711,546, the contents of U.S. patent application Ser. No. 11/711,374, and the contents of U.S. patent application Ser. No. 11/732,995 are each hereby incorporated by reference herein in its entirety.

BACKGROUND OF THE INVENTION

Field of the Invention

The present invention relates generally to games of chance, and more particularly to novel variations on the roulette wheel and wagers placed thereon. The present invention comprises a roulette wheel comprising alphabetic characters and rainbow colors, and multiple balls. The balls may come to rest upon at least two letters for forming a letter couplet, triplet, etc. The combination of letters may form syllables or words, which formations may be coupled to tones for eliciting an enhanced gaming experience.

Description of the Prior Art

Gaming is ancient. Over time, core gaming themes and gaming rules have developed, which continue to enjoy wide popularity. In order to infuse some element of novelty into ancient games, gaming enthusiasts continually strive to enhance the gaming experience through inventive approaches to play. Roulette, for example, has been credited to many ancient sources, including Chinese origins and Roman origins. A more popularly held belief is that Blaise Pascal, the French mathematician (1623-1662) and physicist helped develop the essential Roulette device(s), due, in part, to his fascination with perpetual motion machines.

Whatever its origin, Roulette has evolved into a casino and gambling game in which a croupier turns a round roulette wheel having 37 or 38 separately numbered pockets in which a ball must land. Conventional roulette wheels comprise pockets or wheel sectors numbered non-sequentially from 1 to 36 alternating between red and black backdrops. Most modern Roulette wheels further comprise at least one green pocket numbered "0". Further, in the United States (as opposed to Europe), most roulette wheels comprise a second green pocket marked "00". ostensibly for increasing the house advantage in the United States as compared to house advantage in European play.

In United States-based play, if a player bets on a single number and wins, the payout is 35:1. Of course, any number of other betting options has become available to the gamer, which options offering lower payoffs, including bets on multiple numbers in various combinations or ranges, on all odd or all even numbers, or by color. Over time, variants on the basic Roulette theme have evolved including electronic betting through computer stations, fully electronic ball spin/wheel simulations, stand alone games on a slot machine or through Internet gaming, multiple balls, and characters other than numerals, such as zodiac symbols and the like.

To be sure, the state of the art relating to roulette gaming devices and the like is well developed, and a search into the state of the art reveals that a number of inventive Roulette-based gaming devices are known in the prior art. Some of the more pertinent prior art relating to Roulette type gaming devices of which the present inventors are aware, is briefly described and set forth below.

U.S. Pat. No. 3,853,324 ('324 patent), which issued to Reiner et al., discloses a Combined Game of Chance and Skill. The '324 patent teaches a combined game of chance and skill which is a modified form of the popular game known as bingo. The game includes a circular playing field, a longitudinal alley extending therefrom and a ball-propelling mechanism mounted at one end of the alley for propelling small and large indicating balls along the alley and onto the playing field. The playing field includes an outer member and an inner disc which are rotatably driven in opposite directions. The outer member is provided with a plurality of indicia-carrying partitions which are spaced to trap the large indicating ball which is propelled onto the playing field but are spaced to allow the small indicating ball to pass through the partitions and onto the inner disc. The inner disc is provided with a plurality of indicia-carrying, ball-receiving pockets adapted to receive the small indicating ball which passes through the partitions.

U.S. Pat. No. 4,222,561 ('561 patent), which issued to Whitten, discloses a Game Device. The '561 patent teaches a roulette type device whereby a predetermined set of word category cards are selected randomly one at a time together with spinning a roulette wheel to select the first letter designation for a word response by the players which satisfies both the category and first letter so selected. It will be seen from an inspection of the '561 patent that the roulette type wheel comprises a series of letters of the Roman alphabet thereon. The Whitten wheel includes a total of thirty-six lettered positions thereon, with certain of the letters being duplicitous. Whitten utilizes the device to enable random selection of a letter by his wheel to designate the first letter of an object from a group of related objects, e.g., kinds of fruit, etc. The subject user or gamer must come up with an object having a name that begins with the letter selected on the Whitten roulette wheel in order to win that particular play or turn.

U.S. Pat. No. 4,887,819 ('819 patent), which issued to Walker, discloses a Casino Board Game. The '819 patent teaches a relatively complex game, incorporating use of a roulette wheel and combines aspects of several different traditional or conventional gambling games. In this regard, the player uses either a card game similar to blackjack or a slot machine to determine the number of spaces to be moved along a segmented path, the particular game being selected by the instructions contained in the segment on which the player landed on the prior move. Each segment also contains further instructions, some of those instructions designating a further gambling apparatus and giving odds. These further apparatuses are a roulette game or a dice game, and the player landing on that segment may gamble at these games at the designated odds. Other players can join in the gambling when the roulette game and the dice game are played. The objective of the game is for a player to avoid penalties designated on the game board, acquire a majority of the playing chips until either all of the other players become "busted" or the casino bank becomes "busted". Notably, no alphabetic layout for the roulette wheel is disclosed.

U.S. Pat. No. 5,259,616 ('616 patent), which issued to Bergmann, discloses a Roulette-Type Coin-Operated Gaming Machine. The '616 patent teaches a process for operating a slot machine that works as a roulette wheel. According to the process, the gambler determines the amount of the stake by introducing coins then by pressing selection keys. A microprocessor determines the result of the game by means of random algorithm. When the chosen number is hit, the microprocessor instructs the coin distributing unit to eject the main prize. When a chosen number is hit, the microprocessor drives another processor with a random generator. The random generator determines, depending on a written algorithm, a gain multiplier which is multiplied by the amount of the stake on the number that was hit. The payment unit is then instructed to distribute an amount in coins which corresponds to the product of the stake on the number that was hit and the gain multiplier.

U.S. Pat. No. 5,553,853 ('853 patent), which issued to Sackitey, discloses a Game Apparatus and Method of Play for Teaching DNA Related Technologies. The '853 patent teaches a game including a selector for selecting a nucleotide from a group of nucleotides normally associated with DNA. By randomly selecting nucleotides and recording the selected nucleotides, each player creates a unique DNA sequence. The DNA sequence is used in one of a variety of game motifs to determine the winner of the game. It will be seen from an inspection of the '853 patent that a roulette-type wheel having a series of seventy-one lettered positions thereon enables play. Certain alphabetic characters are repeated, with several (Roman) alphabetic characters being omitted from the wheel.

U.S. Pat. No. 5,755,440 ('440 patent), which issued to Sher, discloses an Enhanced Roulette-Style Game. The '440 patent teaches a new Roulette apparatus comprising multiple balls and separate tracks for launching each of the balls. In a preferred embodiment there are two balls and two tracks, and a special apparatus for launching the balls. In one embodiment the launching apparatus is air powered, and in another the apparatus is mechanical with the balls accelerated by contact with a spinning wheel. In either case the launching apparatus may be hand-held or mounted to a frame and positioned to propel the balls into the tracks. In another aspect of the invention the wheel of the Roulette apparatus is provided as a dynamic display, which may be of several different types, such as LCD and dynamic holographic displays, and electronic player stations are provided wherein players may customize and place bets. In many embodiments the games are enhanced by audio effects including such sounds as balls being launched, balls rolling in Roulette apparatus, thunder strikes, and music. U.S. Pat. No. 6,164,647 ('647 patent), which issued to Chee, discloses a Casino Wheel Game System. The '647 patent teaches a roulette assembly comprising a lower wheel divided into a plurality of sections each representative of at least one of a unique number and a unique color. Also included is an upper wheel rotatably mounted on the lower wheel and divided into a plurality of sections each representative of at least one of a unique number and a unique color. Upon the upper wheel and the lower wheel being spun, the upper wheel slows to engage with the lower wheel and a unique number and color combination is indicated. It will be seen from an inspection of the '647 patent that a mechanically complex roulette wheel is disclosed. Upper and lower wheels may be randomly joined to select a specific color and number outcome on the lower wheel. Notably, no alphabetic designations on the wheel are disclosed.

U.S. Pat. No. 6,227,542 ('542 patent) and U.S. Pat. No. 6,663,106 ('106 patent), both of which issued to Cosmi, disclose certain Roulette of Improved Type and New Gambling Game Providing for the Use of Said Improved Roulette. The '542 and '106 patents teach roulette of a new type including two bowls coaxial to each other and rotating around the same axis and two small balls, each ball rolling around one of the bowls, where on each bowl are engraved data which refer to an independent event. On a first embodiment, the two independent events are: the signs of the zodiac, the numbers from 0 to 31, where the signs of the zodiac are preferably engraved on the external, ring-shaped bowl, while the numbers from 0 to 31 are preferably engraved on the internal bowl. On a second embodiment, the events engraved on the two bowls are related to one or more of the calendars used in Asiatic countries (China, Korea, Japan and so on). Furthermore, a new gambling game providing for the use of said improved roulette is described.

U.S. Pat. No. 6,406,022 ('022 patent), which issued to Nadibaidze, discloses a Method of Playing a Roulette-Type Mass Amusement Game Having a Betting Field with Zodiac Signs. The '022 patent teaches a method of mass amusement using a stake field simulating a roulette-type betting field with various-color stake squares with various-color information marks from 1 to 36 formed thereupon and the twelve Zodiac signs in the stake squares with digital information marks 1, 2, 3, 5, 7, 11, 13, 17, 19, 23, 29, and 31. Also formed is a flat image of a stationary roulette wheel having 36 main sectors and one or two additional sectors, with each main sector to contain, first, the images of digits from 1 to 36 with the images of the twelve Zodiac signs in the places of location of the prime numbers 1, 2, 3, 5, 7, 11, 13, 17, 19, 23, 29, and 31, and, secondly, two images of the hexagonal die with information marks being various number of spots: from one to six. Then, the players place their bets on the stake squares of the stake field, the procedure to be followed by choosing two pairs of random gambling indices by means of double simultaneous casting of two hexagonal dice.

United States Patent Application Publication No. 2005/0285336, which was authored by Ilievski, discloses an alphabetic roulette game comprising a roulette wheel having twenty-five positions thereon, comprising the twenty-six letters of the Roman alphabet and a double letter position. A wagering surface or table provides for the placement of wagers upon the chance of any of the single letters (or the double letters) or a letter of any of several groups of letters turning up on a spin of the wheel. The game also provides for wagers on the chance of a given letter turning up on two or more consecutive turns of the wheel. A further wagering opportunity is provided for wagering upon the chance of a letter within a given word or words coming up on a turn of the wheel. The alphabetic positions on the wheel, and corresponding positions on the table, may be colored to allow players to place wagers on a color or colors, as desired.

It will be seen from a further review of the above-referenced patents and other prior art generally known to exist, however, that the prior art does not teach a roulette type game for forming syllabic letter couplets or words utilizing multiple dice and alphabetic characters, which couplets and/or words, when formed via roulette type balls, may be operably coupled to certain means for providing tones, all of which functions to stimulate the gamer's senses for enhancing the overall gaming experience. The prior art thus perceives a need for a syllabic roulette game incorporating syllable or mono-syllable word formation cooperably keyed with tone formation (optionally in solmization) for enhancing the gaming experience.

SUMMARY OF THE INVENTION

Accordingly, it is an object of the present invention to provide a vibrant rainbow themed roulette game, in which the rainbow theme may be extended to enable one or more levels of so-called Mystery Jackpot prizes or awards. As a means to enable various jackpot prizes or award, the present invention provides a syllabic roulette game for eliciting an enhanced winning experience as achieved via the visual and/or aural stimulation of a roulette game user.

The syllabic or alphabetic roulette game essentially comprises a roulette medium, a wager enabling layout, and a plurality of balls. Notably, the roulette medium, as preferably definable by a wheel or simulative wheel, comprises a plurality of ball-receiving sectors, and certain tone-provision means for providing auditory tones. Each ball-receiving sector comprises a superior sector surface bearing a select wheel- or medium-based alphabetic character and select rainbow type colorization, the select rainbow colorization is preferably selected from the color group consisting of red, orange, yellow, green, blue, indigo, and violet. A plurality of select ball-receiving sectors is cooperably keyed to the tone-provision means for providing a select auditory tone.

The wager support surface is preferably disposed adjacent the roulette wheel for facilitating wager placement, and comprises a plurality of wager-receiving sections, each wager-receiving section having a superior section surface bearing a select, wager-based alphabetic character, the wheel-based and wager-based characters having paired character correspondence. The sector-stimulating or character-identifying balls are each receivable in one of the ball-receiving sectors. The select ball-receiving sectors cooperably provide the select auditory tone when the sector-stimulating balls are received thereby. The paired character correspondence and the select auditory tone together function to visually and aurally stimulate a user's senses for enhancing the gaming experience.

Other objects of the present invention, as well as particular features, elements, and advantages thereof, will be elucidated or become apparent from, the following description and the accompanying drawing figures.

BRIEF DESCRIPTION OF THE DRAWINGS

Other features of our invention will become more evident from a consideration of the following brief description of our patent drawings:

FIG. 10 is a depiction of a three-leveled "mystery jackpot" table showing a mystery jackpot minimum column, a mystery jackpot maximum column, and a mystery jackpot percentage column.

FIG. 11 is a depiction of a second payout table for the second roulette wheel of the present invention showing a second column of bet names, a second column of numbers, a second column of payouts, and a second column of expectations.

FIG. 18 is a depiction of a sixth payout table for the fourth wager layout table of the present invention showing a sixth column of bet names, a sixth column of numbers, a sixth column of payouts, and a sixth column of expectations.

FIG. 19 is a depiction of a two-leveled "mystery jackpot" table showing a mystery jackpot minimum column, a mystery jackpot maximum column, and a mystery jackpot percentage column.

DETAILED DESCRIPTION OF THE PREFERRED EMBODIMENT(S)

Figure 1:
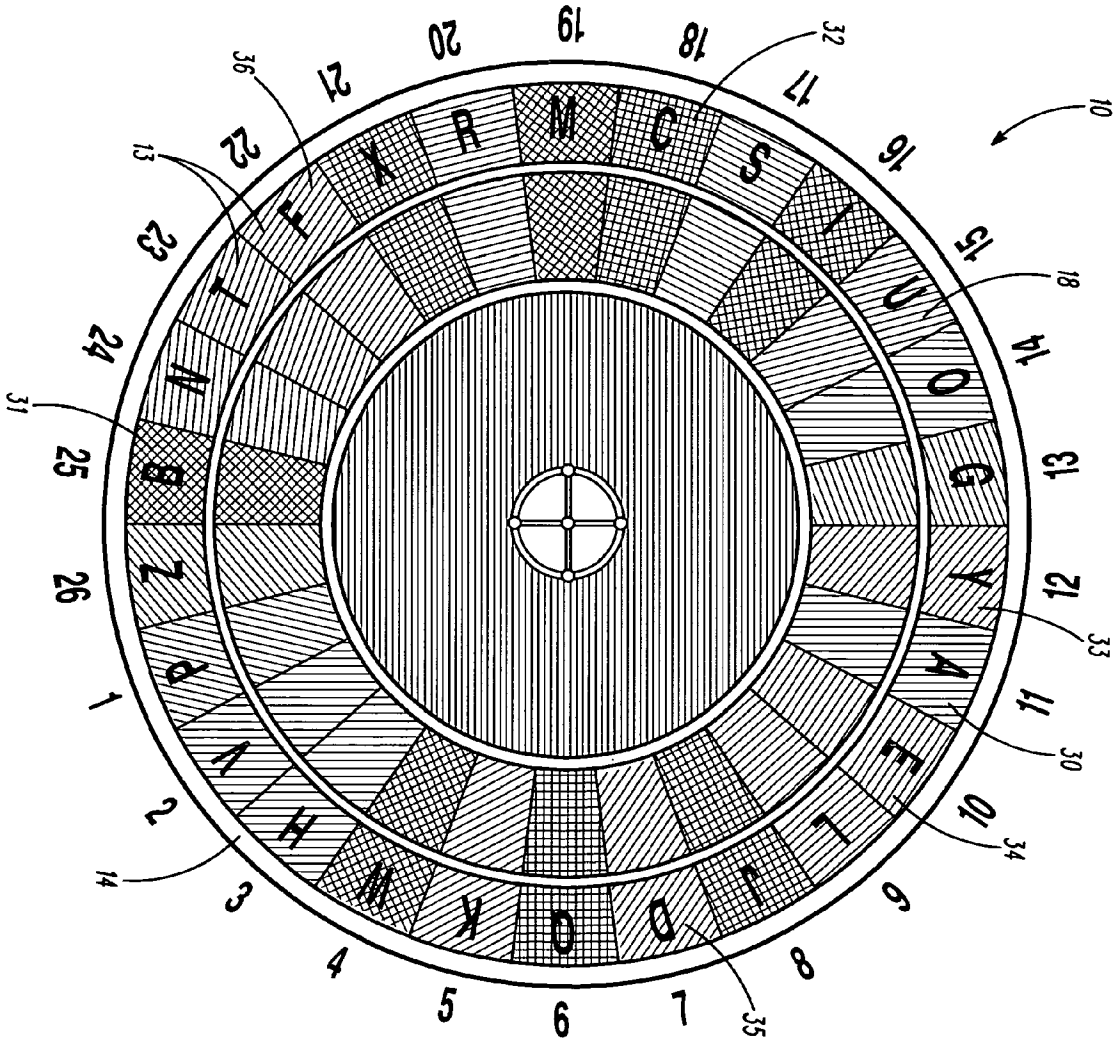
FIG. 1 is a top plan view of a first roulette wheel of the present invention showing a plurality of ball-receiving sectors, each bearing a select Roman alphabetic character and one of a series of seven rainbow colors.

Referring now to the drawings, the preferred practice of the present invention generally involves a musical or tonal alphabet rainbow roulette game with at least two balls spun, and two alphabetic characters selected or identified by the balls when coming to rest. For purposes of the present invention, it is contemplated that rainbow type colors may preferably be included as a visually stimulating backdrop to the alphabetic characters, which colors may comprise Red as indicated at 30, Orange as indicated at 31, Yellow as indicated at 32, Green as indicated at 33, Blue as indicated at 34, Indigo as indicated at 35, and Violet as indicated at 36 in FIG. 1. The colors Red 30, Orange 31, Yellow 32, Blue 34, Indigo 35, and Violet 36 are further referenced in FIG. 20. It is contemplated that the preferred rainbow colors Red 30, Orange 31, Yellow 32, Green 33, Blue 34, Indigo 35, and Violet 36 may be incorporated into the design of the present invention according the familiar ROY G. BIV mnemonic device used for memorizing the traditional optical spectrum. It is believed that any number of other color variants and electromagnetic wavelengths may be incorporated into the design of the present invention according to the designer's taste or election.

Figure 9:
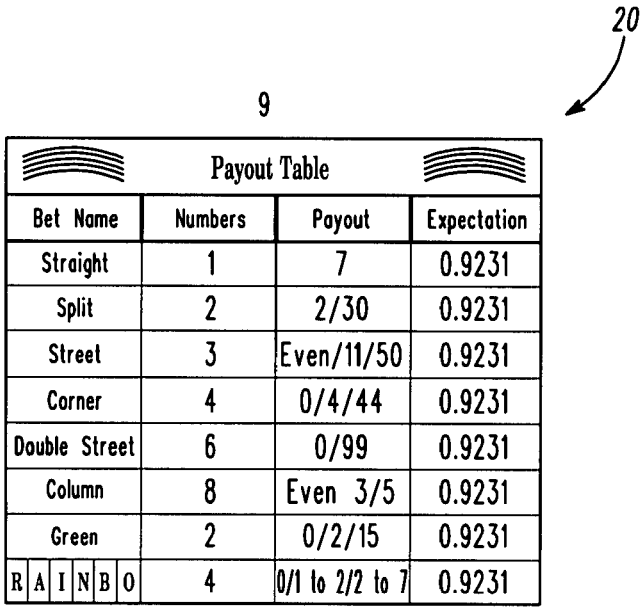
FIG. 9 is a first payout table of the present invention showing a first column of bet names, a first column of numbers, a first column of payouts, and a first column of expectations.

A first payout table 20 (for use in combination with a one-ball roulette wheel of the present invention) is illustrated and depicted in FIG. 9, which payout table 20 reflects the different odds of winning for a first embodiment of the present invention. A second payout table 21 (for use in combination with a two-ball roulette wheel of the present invention) is illustrated and depicted in FIG. 11, which payout table 21 reflects the different odds of winning for a second embodiment of the present invention. It will be seen from a comparative inspection of the payouts columns in FIG. 9 versus FIG. 11 that in FIG. 11 there are two payouts shown. This reflects different pays for hitting one or both of the selected numbers with the bet criteria selected. For example, if the user or player selects a rainbow color Yellow 32 and one of the balls lands on Yellow 32, he/she will be paid "even money". However, if both balls 12 land on Yellow colors 32, he/she would be paid at 19:1.

It is a primary purpose of the present invention to spell trigger words or syllables via a single roulette "spin," and in this regard, it should be noted that a plurality of balls 12 enable the player to spell or form said trigger words or syllables. An added musical betting option called "scales" may be included which rewards the players with a progressive or jackpot prize if any of the following solfege letter couplets or syllables of the diatonic scale occur: "DO", "RE", "MI", "FA", "SO", "LA", "TI". It is anticipated that this jackpot may be won about every 46 games. This gives scope for a low to medium jackpot prize amount depending upon how the jackpot parameters are configured, the means of betting on the jackpot, and the division of prizes.

It is contemplated that if the forgoing jackpot scheme may be easily tailored to operate on an electronic slot machine type version of the roulette game, or in an online, networked, or Internet-based medium, in which individualized player-based machines may be linked to a chain of several similar machines, and which machines may all be linked to a common jackpot. In this scenario, there would be relatively frequent winners. The "DO, RE, MI" music or tonal scale would be played by the jackpot controller whenever there was a "scales" winner. In an alternative practice with a slot machine, there could be seven different slots in the jackpot with each one having a different "scale" station name. Thus, the probability of each station hitting on any spin would be reduced by a factor of seven, thereby resulting in higher prizes. The reader is directed to FIG. 11 for further information regarding the "scales" betting options contemplated by the present invention.

Figure 3:
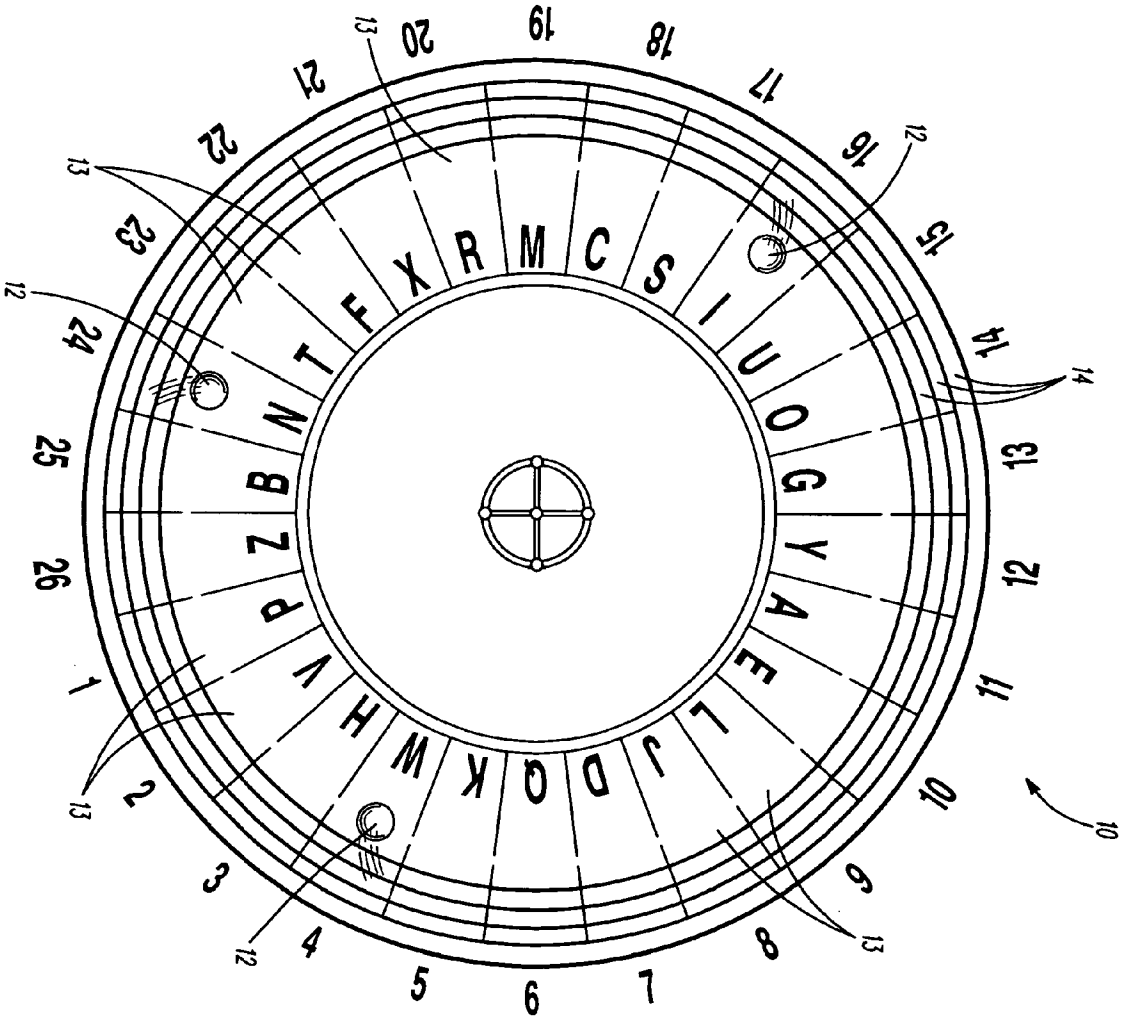
FIG. 3 is a top plan view of a third roulette wheel of the present invention showing a plurality of ball-receiving sectors, each bearing a select Roman alphabetic character, and three character-identifying balls being deposited in the "W", "I", and "N" (or "W.I.N.") character sectors.

In another extension or practice of the invention, it is contemplated that three balls 12 may be utilized. In this case, it is contemplated that an added progressive jackpot may be included based on whether the balls land such that a win may occur if a three letter word in a prescribed list is formed. For example, formation of the word, "WIN" (as generally depicted in FIG. 3) may mean the winning of a progressive prize. It may be seen from an inspection of FIG. 12 that thirteen "seats" 40 may be situated at the table, each seat 40 having its own unique three letter word 41.

It is contemplated that for electronic slot machines (or online gaming portholes and the like) participating in a linked progressive, each slot could have its own unique three letter word/code. If that word/code appeared on the machine on which the player was gaming, the progressive jackpot would be won. The probability of any nominated three letter word 41 appearing in a single spin is 0.00038 or once in every 2,600 games. If a full table, with all thirteen seats 40 or stations active, it is anticipated that the progressive jackpot may be won once every 200 games on average. Notably, from a further inspection of FIG. 13, it may be seen that there are different payouts depending on how many balls 12 in the category are hit. For example, if Column bet is selected, then there is no payout if one ball 12 is hit; 2:1 if 2 balls 12 are hit; and 15:1 in all three balls 12 are hit.

Figures 12, 13:
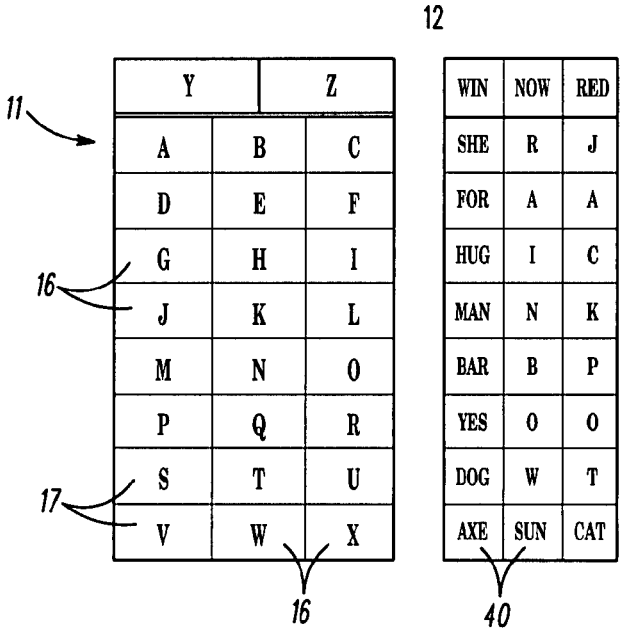
FIG. 12 is a depiction of the first wager layout table with a sample second water layout table showing 13 table seats, each seat bearing its own unique three letter word all with color removed for clarity.
FIG. 13 is a depiction of a third payout table for the third roulette wheel of the present invention showing a third column of bet names, a third column of numbers, a third column of payouts, and a third column of expectations.
Figures 14, 15:
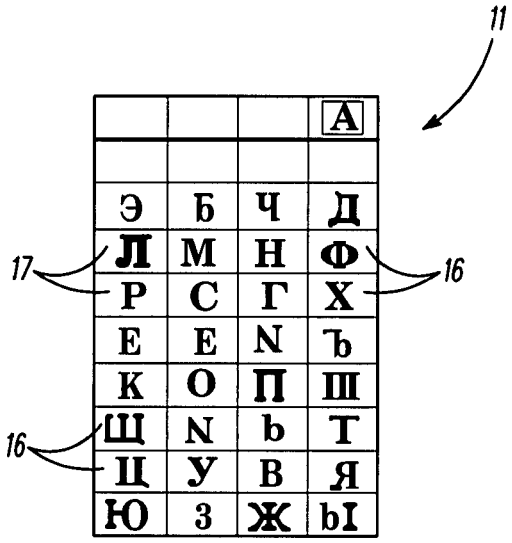
FIG. 14 is a depiction of a fourth payout table for the third roulette wheel of the present invention showing a fourth column of bet names, a fourth column of numbers, a fourth column of payouts, and a fourth column of expectations.
FIG. 15 is a depiction of a third wager layout table of the present invention showing a Russian alphabetic character set with color removed for clarity.
Figures 16, 17:
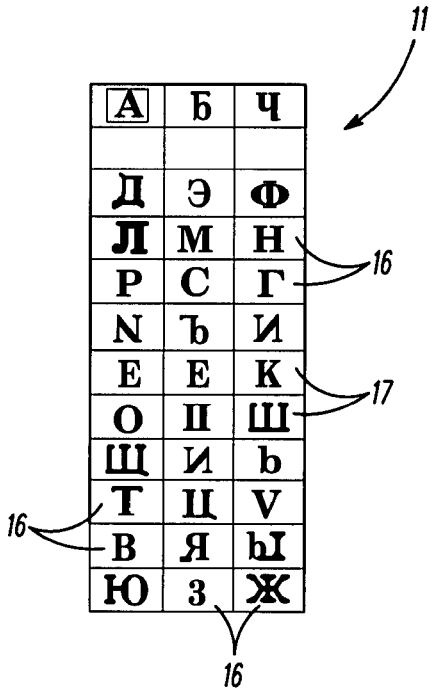
FIG. 16 is a depiction of a fifth payout table for the third wager layout table of the present invention showing a fifth column of bet names, a fifth column of numbers, a fifth column of payouts, and a fifth column of expectations.
FIG. 17 is a depiction of a fourth wager layout table of the present invention showing a Russian alphabetic character set with color removed for clarity.

For a table game or linked electronic, slot-type or online porthole-type roulette game, it is contemplated that each "seat" 40 in the alphabet rainbow roulette table would have its own unique word 41 for which the progressive jackpot would apply for that seat 40 only. Thus one seat 40 could be assigned the word, "WIN", another "NOW", another "RED", etc. as generally depicted in FIG. 12. This structure solves the problem of dramatically diminishing payouts otherwise exhibited if there were only a single progressive jackpot winning word 41 with plurality of winning patrons winning simultaneously. For a gaming machine, where each player is independent of all others participating in the progressive jackpot, the electronic table game (EGM) (a hybridized table game with slots) could either: automatically and randomly assign the word 41, or enable the player to select the word 41 from a prescribed list. In the former scenario, it is contemplated that the means for assigning the word 41 might comprise the step of nominating each slot station with a word 41 as directed from the "Scales" jackpot or "WIN" jackpot.

It is contemplated that participation in the jackpot may comprise one of three options as encapsulated by the following: (1) Players may elect to place a bet on the jackpot word. This option may lead to higher payouts. (2) Players who place any other bets are automatically eligible to win the progressive if their word comes up. (3) Players who place at least a minimum bet amount, which may be a system set parameter, are automatically eligible to win the progressive if their word comes up. A further option on this variation is to spin or incorporate four balls 12 instead of three balls 12. Players would then have four letter words assigned from which they can win the progressive jackpot if all four letters of the word appear. The advantage of this structure is that higher progressive prizes may be achieved. Notably, any of the participation options set forth hereinabove may be opted.

It is further contemplated that a mystery jackpot option may be incorporated into the structure. In this aspect of the invention, there will be only one winning word combination "WIN" for the three-ball game or version. The difficulty with only a single word is that many players will be sharing the jackpot and the prize will not be very large or unique. This problem may be easily addressed. In the situation where the jackpot win trigger occurs (e.g. the word "WIN" is spelled out with the three balls 12 drawn), a secondary jackpot winner selection process occurs. Each player may preferably be rated by the amount of money, credits, or similar other property he/she was wagered on all bets on that game.

For example, assume that there were just two players (Player A and Player B) in the game with the WIN event occurred. Player A had bet 10 credits on that game while Player B had bet 90 credits. They would be given a rating of 10 and 90 each which would mean that a probability of 0.1 would be assigned to Player A and a probability of 0.9 to Player B. A random number would be drawn by the jackpot controller to decide which of the players was to win—say it was in the range of 0.01-1, then if the random number drawn was 0.05, Player A would win; if 0.75, Player B would win. This would be highly advantageous for the gaming establishment running the game for when the jackpot started incrementing up to a relatively high amount, players would be encouraged to make larger regular wagers in order to have a better chance of being the selected winner when the WIN jackpot occurred. The same principle could be applied with the scales jackpot discussed hereinabove.

The foregoing thus describes a certain gaming award method inherently taught by the present invention. In this regard, it is contemplated that the gaming award method may well function to enhancing the gaming experience, and comprise the steps of accepting a plurality of wagered predictions, which wagered predictions predict an event outcome preferably definable by the formation of a meaningful character string formable via the alphabetic characters or the roulette game. Notably, the wagered predictions may necessarily comprise certain wager sums, which sums differ in magnitude. After accepting the predictions, probability ratings may be assigned thereto, which probability ratings correspond to the wager sum magnitudes. Then a (percentage-type) random number may be drawn from an award controller, the random number being selected from a number range ranging from 0.01 (1%) to 1 (100%). After drawing the random number, the same may be compared to the probability ratings noting the differences between the various probability ratings, which differences correspond to the initially offered wager sums. The differences may then be ranked and property, such as credits, tokens, or cash, awarded to the highest ranked wager sum.

Figure 2:
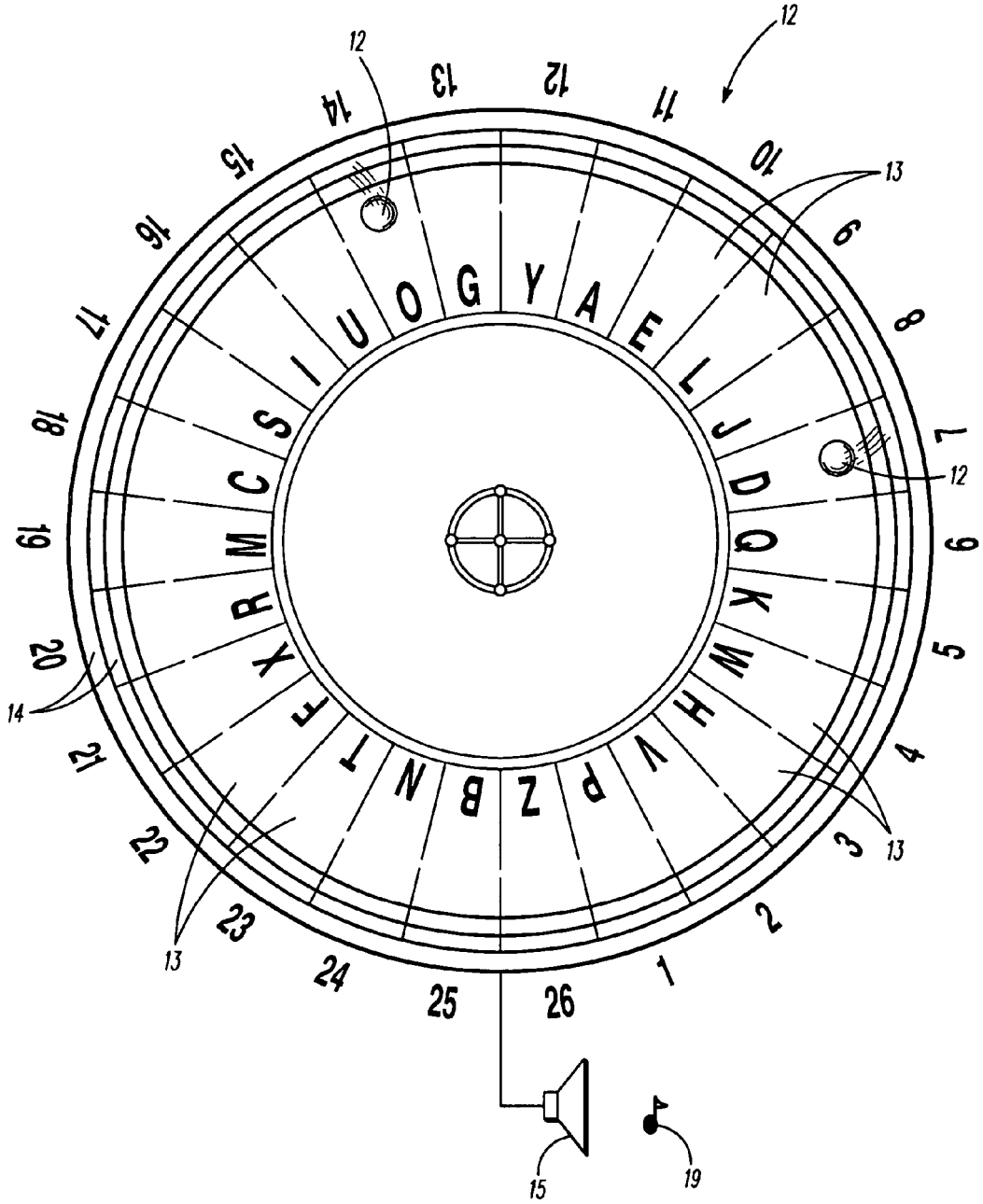
FIG. 2 is a top plan view of a second roulette wheel of the present invention showing a plurality of ball-receiving sectors, each bearing a select Roman alphabetic character, and two character-identifying balls being deposited in the "D" and "O" (or "D.O.") character sectors.

In terms of prompting tones in any of the games with two or more balls 12, it is contemplated that if a scale word or syllable is hit, a musical tone (corresponding to the letter couplet syllables: "DO", "RE", "MI", "FA", "SO", "LA", "TI") in solmization may be provided. In this regard, it is contemplated that the select auditory tones may preferably be diatonically scaled and keyed to a syllabic letter couplet grouping in solmization, the syllabic letter couplet grouping consisting of "DO," "RE", "MI", "FA", "SO", "LA", and "TI", wherein the syllabic letter couplet "DO" corresponds to a tonic in the diatonic scale. The DO trigger event is generally depicted in FIG. 2 for the reader's inspection.

It is contemplated that the betting layout could conceivably cover three types of bets, including: (1) Grouped notes in the exact same concept as the field bet in craps, the concept being that if "DO" is hit, that it would pay roughly double what the other six notes would pay. (2) Individual side bets for each of the seven notes of the diatonic scale. (3) A trigger for the combined Progressive/Mystery jackpot. It will be noted that the syllabic word couplet "DO" is pronounced "dough", a common slang term for money; the conventional prize or award sought in games of chance such as roulette. It is contemplated that this play on syllabic-tonal content is but one feature that may add to or enhance the gaming experience.

If a mechanical roulette device were being utilized, with two balls 12 being spun, it is contemplated that the grouped or field bet would pay 36:1 if "RE", "MI", "FA", "SO", "LA", or "TI" appeared and 73:1 if "DO" appeared. The overall return for this type of bet would be 91.08%. Each individual side bet would pay 295:1, and the overall return for this bet type would be 91.08%. If matching any of the 7 scale letter couplets (or syllables) were to trigger a jackpot, the occurrence of the jackpot would be about ever 46.5 games. If three balls 12 were to be spun, the grouped or field bet would pay 12:1 if "RE", "MI", "FA", "SO", "LA", or "TI" appeared and 29:1 if "DO" appeared. The overall return for this type of bet would be 91.85%. Each individual side bet would pay 99:1, and the overall return for this bet type would be 91.38%. If matching any of the 7 scale words were to trigger a jackpot, the occurrence of the jackpot would be about every 15.75 games. It is contemplated that the payouts could be manipulated such that if two scale words were formed from the three balls, e.g. "FAL", "SOD", or "MIT", extra sums would be paid. It should be noted that some gaming establishments may wish to limit the liability for large bets. For example, it is contemplated that a maximum payout of $10,000 may be practiced.

It is contemplated that side bets may be summarized by the following: (1) the rainbow colors Red 30, Orange 31, Yellow 32, Blue 34, Indigo 35, and Violet 36 may function to enable 6 different bets, in the same manner as more conventional red and black. (2) Notably, Green 33 would not be necessary as it could represent a small street bet on the top line. (3) Columns. (4) First and last 12). (5) Street, Double Street. (6) Scales "field" bet. (7) Individual scales side bets (seven). (Pairs, Corners (groups of 4)).

It is thus contemplated that the preferred embodiment of the present invention generally concerns a colorful syllabic roulette game, which game is designed to provide awards for forming meaningful character strings (including mono-syllabic words). The formed character strings may further be operably coupled to certain means for providing tones when triggered by the events. Thus the syllabic roulette game may well function to elicit an enhanced winning experience through visual and aural syllabic-based stimulation. The syllabic roulette game of the present invention preferably comprises a roulette wheel 10 as illustrated and referenced in FIGS. 1-7; a wagering layout or wager-enabling structure or surface 11 as illustrated and referenced in FIGS. 8, 12, 15, 17, and 20; and a plurality of sector-stimulating or character-identifying spheres or balls 12 as illustrated and referenced in FIGS. 2-7.

The roulette wheel 10 preferably comprises a plurality of evenly spaced radially inward sphere-receiving sectors 13 as illustrated and referenced in FIGS. 1-4; a plurality of radially outward sphere-launching track rings 14 as illustrated and referenced in FIGS. 1-7; and certain means for providing auditory or aural tones or tone-provision means, schematically depicted (as a speaker in circuit with roulette wheel 10) at reference numeral 15 in FIG. 2. It may be seen from a comparative inspection of FIGS. 1-4 versus FIGS. 5-7 that track rings 14 may be preferably stepped in order to guide balls 12 initially in radially outward adjacency to sectors 13 (radially inward) to enhance random deployment from the rings 14 into various sectors 13. Further, depending on the number of balls 12 to be utilized or characters 18 to be identified, it is contemplated that the number of track rings 14 may preferably equal the number of balls 12 as a means to enhance random deployment as may be seen from a general consideration of FIGS. 5-7.

As been noted hereinabove, it is contemplated that each sphere-receiving sector 13 may preferably comprise a colored superior sector surface, each of which surfaces preferably further bear a select alphabetic wheel-based character 18. As may be seen from an inspection of FIGS. 1 and 20, a plurality of colors is represented as depicted by various types of hatch markings. For example, the Roman alphabetic characters Y and Z as depicted in FIG. 1 are preferably accompanied by Green 33 coloration as depicted by hatch markings designated as green under United States Patent and Trademark Office rules of practice with regard to color depictions. Similarly, the Roman alphabetic characters A, H, O, and V are preferably accompanied by a Red' 30 coloration; the Roman alphabetic characters B, I, M, and W are preferably accompanied by an Orange 31 coloration; the Roman alphabetic characters C, J, Q, and X are preferably accompanied by a Yellow 32 coloration; the Roman alphabetic characters E, L, R, and S are preferably accompanied by a Blue 34 coloration; the Roman alphabetic characters D, K, P, and U are preferably accompanied by an Indigo 35 coloration; and the Roman alphabetic characters F, G, N, and T are preferably accompanied by a Violet 36 coloration. As earlier set forth, the noted colors comprise or denote the popular mnemonic ROY (G.) BIV for the optical spectrum or rainbow of colors.

For a mechanical version of the roulette game, it is contemplated that a plurality of select sphere-receiving sectors 13 may comprise certain pressure-sensitive portions for activating the tones (not specifically illustrated). The pressure-sensitive portions of the select sphere-receiving sectors 13 (i.e. those sectors that enable tone provision) may thus be considered to comprise, in part, the tone provision means. For example, it is contemplated that when a ball 12 comes to rest upon a select sector 13, a pressure-sensitive switch may be actuated for closing circuitry that operates to provide a select tone. For an electronic (slot-type or online gaming-type) version of the roulette game, it is contemplated that the select sectors 13 may be preprogrammed to play the tones as prompted by character-identifying balls 12.

Figure 20:
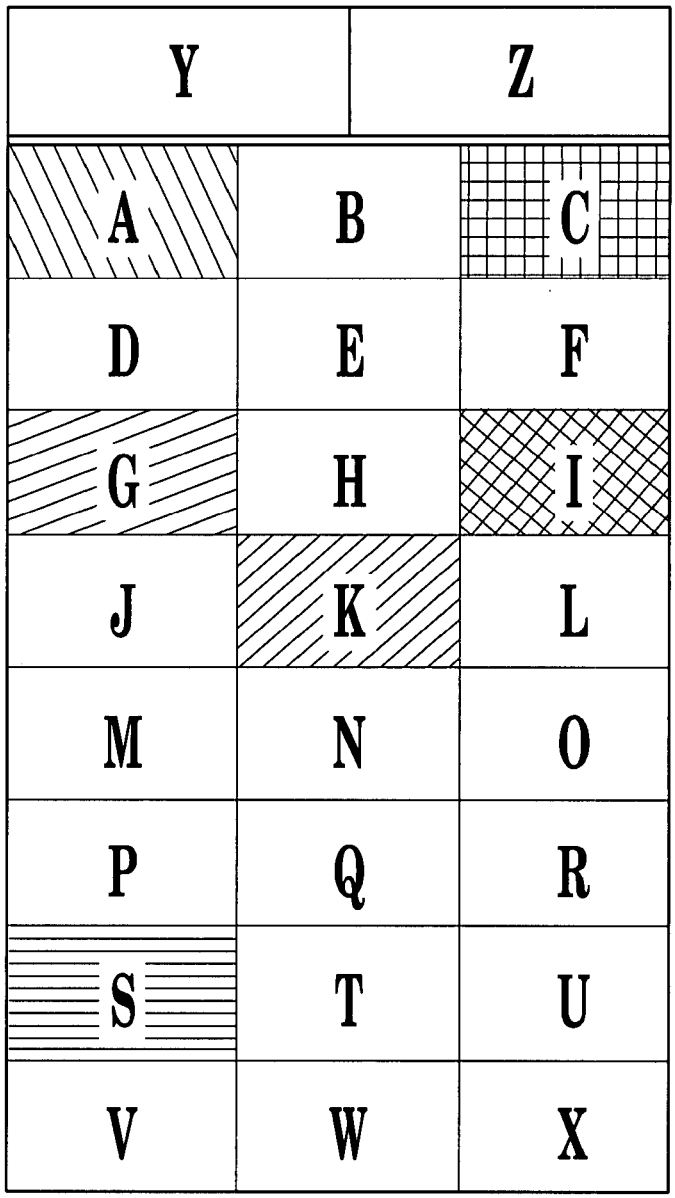
FIG. 20 is an enlarged depiction of the first wager layout table of the present invention showing a Roman alphabetic character set with seven representative colors included for clarity.

It is contemplated that the wagering surface or layout 11 or wager-enabling structure of the present invention may preferably be disposed adjacent the roulette wheel 10 for facilitating wager placement thereupon or thereby. In this regard, the reader is directed to FIGS. 8, 12, 15, 17, and 20. From an inspection of the noted figures, it will be seen that gamers may place wagers upon a plurality if wager-receiving or wager-enabling sections 16 prior to ball deposition. Each of the wager-receiving sections 16 comprise a superior section surface, which section surfaces each bear a select alphabetic wager-based character 17 having one-to-one correspondence with the wheel-based characters 18. It will be understood that the wheel-based and wager-based characters 18 and 17 have paired character correspondence, and thus the sections 16 also preferably comprise rainbow color backdrops corresponding to the previously specified breakdown. From an inspection of FIG. 20, for example, it may be seen that A comprises Red 30 coloration, C comprises Yellow 32 coloration; G comprises Violet 36 coloration; I comprises Orange 31 coloration; K comprises Indigo 35 coloration; and S comprises Blue 34 coloration. The remaining sections 16 as depicted in FIG. 20 have been purposely illustrated without coloration (otherwise necessarily present) for ease of visual interpretation.

Figure 4:
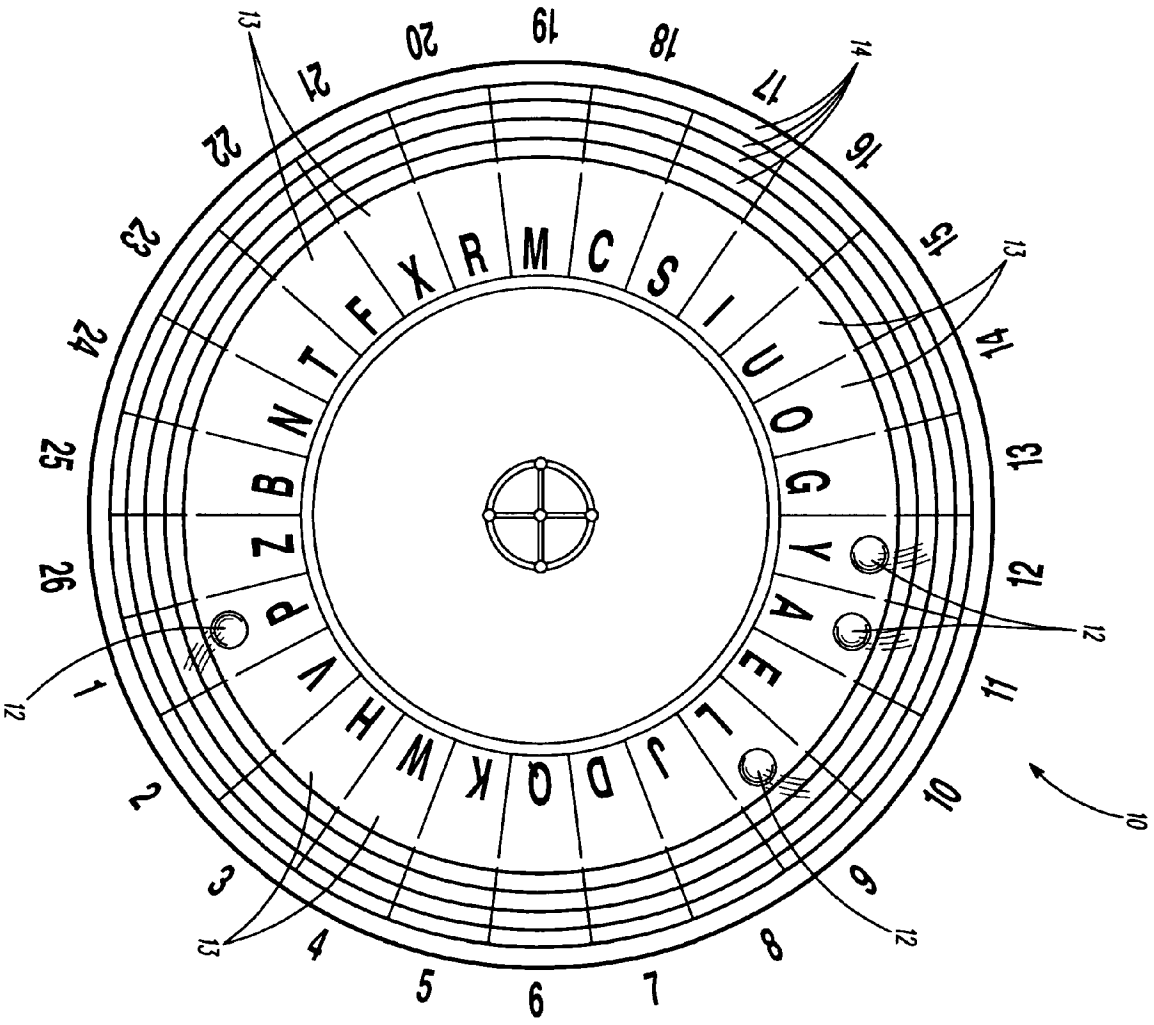
FIG. 4 is a top plan view of a fourth roulette wheel of the present invention showing a plurality of ball-receiving sectors, each bearing a select Roman alphabetic character, and four character-identifying balls being deposited in the "P", "L", "A", and "Y" (or "P.L.A.Y.") character sectors.
Figure 5:
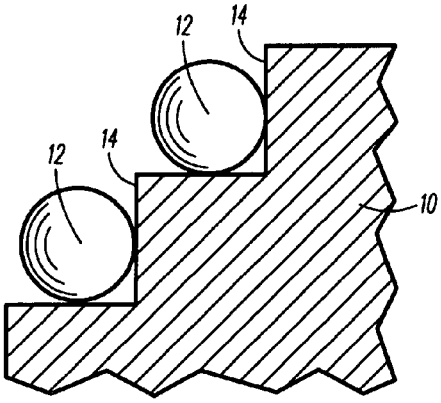
FIG. 5 is a fragmentary cross-sectional side view of a portion of the second roulette wheel of the present invention depicting two character-identifying balls in two ball-launching track rings.
Figure 6:
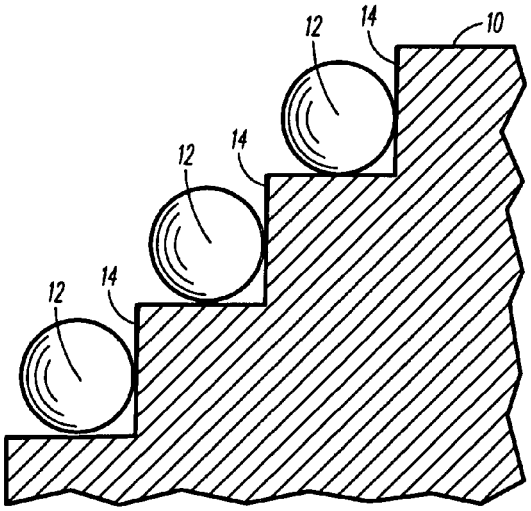
FIG. 6 is a fragmentary cross-sectional side view of a portion of the third roulette wheel of the present invention depicting three character-identifying balls in three ball-launching track rings.
Figure 7:
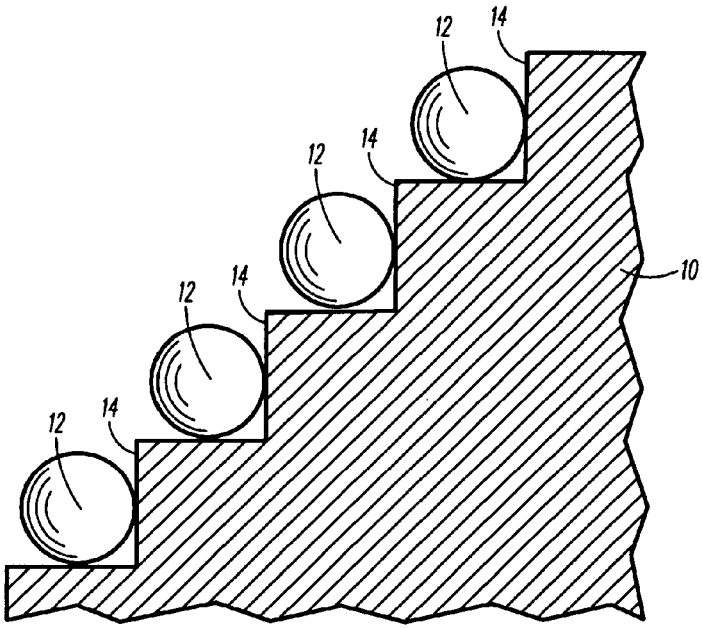
FIG. 7 is a fragmentary cross-sectional side view of a portion of the fourth roulette wheel of the present invention depicting four character-identifying balls in four ball-launching track rings.
Figure 8:
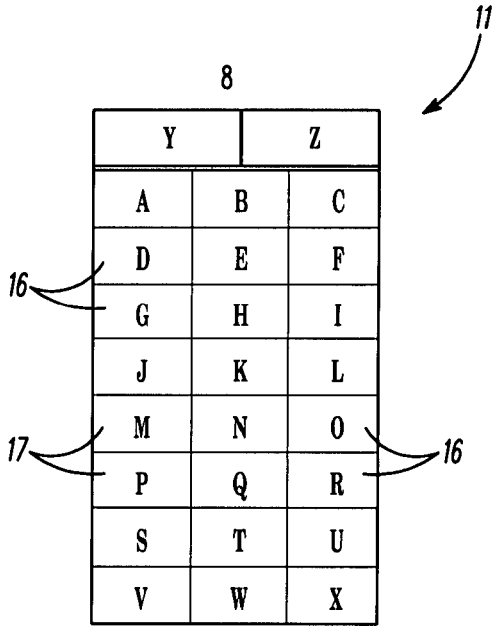
FIG. 8 is a depiction of a first wager layout table of the present invention showing a Roman alphabetic character set with color removed for clarity.

The sector-stimulating or character-identifying spheres or balls 12 are launchable from the sphere-launching track rings 14 and receivable in one of the sphere-receiving sectors 13 as generally depicted in FIGS. 2-4. When a triggering event such as the formation of a syllable in solmization (e.g. "DO") occurs, a tone (as at reference numeral 19 in FIG. 2) may then be provided via the tone-provision means 15. In other words, the select sphere-receiving sectors 13 function to cooperably provide the select auditory tone 19 when the sector-stimulating spheres 12 are sector-received. Together, the paired character correspondence between the wheel 10 and the layout 11, and the select auditory tone 19 function to visually and aurally stimulate a user's senses for eliciting an enhanced gaming experience.

While the above description contains much specificity, this specificity should not be construed as limitations on the scope of the invention, but rather as an exemplification of the invention. For example, as is described hereinabove, it is contemplated that the present invention essentially discloses a syllabic roulette game for visually and aurally stimulating a game user, the syllabic roulette game comprising a certain roulette medium, such as a wheel, and a plurality of sector-stimulating balls. Where wagering on ball deposition outcomes is preferred, a wager support surface or layout may be further provided.

The roulette medium may preferably comprise a plurality of ball-receiving sectors, and each ball-receiving sector may preferably comprise a sector surface bearing a select, medium-based, solfege-enabling, alphabetic character. In this last regard, it has been noted that Roman alphabetic characters are but one form of alphabetic character. From an inspection of FIGS. 15 and 17, it will be seen that other alphabetic characters, such as the Russian alphabetic character set, may be incorporated into the game and still be encompassed by the teachings set forth herein. Notably, payout structures and odds of winning may be slightly altered depending on the alphabet character set as may be seen from a comparative inspection of FIGS. 9, 11, 13, and 14 versus FIGS. 16 and 18. Other types of alphabet character sets such as Greek, Chinese, Japanese, Arabic, and similar other sets of alphabetic character sets may be used, it being noted that solmization is not limited to scales coupled to meaningful character strings dictated by Roman alphabetic character strings or the like.

The sector-stimulating balls or character identifiers are receivable in one of the ball-receiving sectors for cooperably enabling single-spin word or syllable formation. It is contemplated that single spin word or syllable formation, enhanced by paired character correspondence may well function to visually stimulate a user and elicit an enhanced gaming experience. Notably, the roulette medium may bear select rainbow type colorization for enabling varying payout schemes including, but not limited to mystery jackpots and the like. Further, the roulette game may preferably comprise certain tone-provision means for providing auditory tones having one-to-one correspondence with the formed meaningful character strings.

Further, it is contemplated that the concepts of the present invention teach certain roulette gaming methodology. In this regard, it is contemplated that the roulette gaming method of the present invention may well function to enhance the roulette gaming experience. The roulette gaming method may preferably comprise the steps of arranging visually perceptive alphabetic characters in radial adjacency to a central roulette wheel axis (of rotation); randomly depositing character identifiers (such as balls 12) in radial adjacency to the axis of rotation, as, for example, in ball-receiving sectors 13; identifying a plurality of alphabetic characters via the deposited character identifiers; forming meaningful character strings via the identified alphabetic characters; and comparing the formed meaningful character strings with prescribed meaningful character strings such as those meaningful character strings set forth in FIG. 12, namely, WIN, NOW, RED, SHE, FOR, HUG, MAN, BAR, YES, DOG, AXE, SUN, and CA, or the solfege-enabling character strings DO, RE, MI, FA, SO, LA, and TI.

Other steps may include the arrangement of a rainbow type colors in radial adjacency to the axis of rotation before randomly depositing the character identifiers in radial adjacency to the axis of rotation. Notably, color arrangements may be randomly assigned or periodically altered in the case of an electronic (slot-type or online gaming-type) roulette format. Further, the prediction of a certain meaningful character string formation may occur before the random deposition of balls or character identifiers in radial adjacency to the axis of rotation, as would be the case when a gamer selects a select alphabetic character, color, or character string before the roulette spin is performed. Typically, the step of wagering property such as money, credits, or similar other property occurs during the step of prediction.

Still further, the roulette gaming method may comprise the step of awarding property such as money, credits, or similar other property after comparing the formed meaningful character strings with the select prescribed character strings. The award may take the form of a mystery jackpot and any number of other payout structures. Notably, the step of sounding a select tone during meaningful character string formation may be included, in which case the formed meaningful character string may preferably correspond to the select tone in solmization.

Accordingly, although the invention has been described by reference to a preferred roulette game and certain methodology associated therewith, it is not intended that the novel game or gaming method be limited thereby, but that modifications thereof are intended to be included as falling within the broad scope and spirit of the foregoing disclosure, the following claims and the appended drawings.

We claim:

1. A roulette apparatus comprising:

a roulette wheel comprising a plurality of radially inward sphere-receiving sectors, a plurality of radially outward sphere-launching rings, and tone-provision circuit, the tone-provision circuit for providing auditory tones, each sphere-receiving sector comprising a superior sector surface, the superior sector surfaces each bearing a select wheel symbol, a plurality of select sphere-receiving sectors being co-operably keyed to the tone-provision circuit for providing a select auditory tone;

a wagering surface that comprises a plurality of wager-receiving sections, each wager-receiving section comprising a superior section surface, the superior section surfaces each bearing a select wager symbol, the wheel and wager symbols having paired character correspondence;

a plurality of sector-stimulating spheres, the sector-stimulating spheres each being launchable from the sphere-launching rings and receivable in one of the sphere-receiving sectors, the select sphere-receiving sectors co-operably causing a predetermined tonal scale to be generated when the sector-simulating spheres are received in respective sphere-receiving sectors; and a jackpot controller used in connection with the jackpot betting option to select a winner when multiple players select the jackpot betting option and win, wherein the jackpot controller produces a random number used to select the winner.

2. The roulette apparatus of claim 1, wherein the superior sector surfaces and superior section surfaces bear select colorization, the select colorization being selected from a color group consisting of red, orange, yellow, green, blue, indigo, and violet.

3. The roulette apparatus of claim 2, wherein the superior sector surfaces and superior section surfaces bear Roman alphabetic characters as the symbols.

4. The roulette apparatus of claim 1, wherein the predetermined tonal scale is diatonically scaled.

5. The roulette apparatus of claim 1, wherein the tonal scale is keyed to a syllabic letter couplet grouping in solmization, the syllabic letter couplet grouping consisting of "DO," "RE," "MI," "FA," "SO," "LA," and "TI".

6. The roulette apparatus of claim 1, wherein the select ball-receiving sectors that are co-operably keyed to the tone-provision circuit bear solfege-enabling characters.

7. The roulette apparatus of claim 1, wherein the superior sector surfaces of sphere-receiving sectors receiving the sector-simulating spheres co-operably form a predetermined character string.

8. The roulette apparatus of claim 1, wherein the predetermined character string corresponds to the predetermined tonal scale in solmization.

9. The roulette apparatus of claim 1, wherein the random number ranges between 0.01 and 1.

* * * * *